United States Patent [19]

Kato

[11] Patent Number: 4,674,274

[45] Date of Patent: Jun. 23, 1987

[54] APPARATUS FOR MANUFACTURING SPUN YARN

[75] Inventor: Hisaaki Kato, Shiga, Japan

[73] Assignee: Murata Kikia Kabushiki Kaisha, Kyoto, Japan

[21] Appl. No.: 929,642

[22] Filed: Nov. 10, 1986

[30] Foreign Application Priority Data

Nov. 15, 1985 [JP] Japan ..... 60-255976

[51] Int. Cl.[4] ..... D01H 5/28; D02G 1/04

[52] U.S. Cl. ..... 57/328; 57/331; 57/333; 57/336; 57/352

[58] Field of Search ..... 57/328–331, 57/333, 336, 352, 350

[56] References Cited

U.S. PATENT DOCUMENTS

| | | | |
|---|---|---|---|
| 2,908,133 | 10/1959 | Brown | 57/336 |
| 4,003,194 | 1/1977 | Yamagata et al. | 57/328 |
| 4,248,038 | 2/1981 | Takai | 57/336 |
| 4,322,944 | 4/1982 | Sraitr et al. | 57/333 X |
| 4,481,759 | 11/1984 | Venot | 57/328 X |
| 4,489,540 | 12/1984 | Faure et al. | 57/328 X |
| 4,492,075 | 1/1985 | Faure | 57/328 X |
| 4,583,355 | 4/1986 | Vignon | 57/328 X |
| 4,584,830 | 4/1986 | Faure et al. | 57/328 |
| 4,593,521 | 6/1986 | Stalder et al. | 57/352 X |

*Primary Examiner*—John Petrakes

*Attorney, Agent, or Firm*—Spensley Horn Jubas & Lubitz

[57] ABSTRACT

An apparatus for manufacturing spun yarn comprising an air jet nozzle and a belt type twisting device, the nozzle having a fiber bundle outlet facing the twisting device and including a fiber bundle guide which is connected to the fiber bundle outlet and has a rear end located close to the intersection of the two belts defining the twisting device.

12 Claims, 7 Drawing Figures

APPARATUS FOR MANUFACTURING SPUN YARN

FIELD OF THE INVENTION AND RELATED ART STATEMENT

This invention relates to an apparatus for twisting a bundle of short fibers to manufacture spun yarn.

Various attempts have been made to develop improved substitutes for a ring spinning machine to realize an improved spinning speed, a simpler spinning process and an improved quality of yarn. They include an open-end spinning machine and an air spinning machine which are already used in practice. A typical air spinning machine includes two air jet nozzles which supply streams of air swirling in mutually opposite directions to a bundle of fibers to twist it to produce spun yarn. This apparatus enables a spinning speed which is several times higher than that of a ring spinning machine. A still higher spinning speed can be obtained if the jet pressure of air is increased. Its spinning capacity is, however, limited, as a drastic increase in air pressure brings about a sharp increase in the amount of energy which is consumed. The development of another new type of spinning apparatus is, therefore, desired. Japanese Laid-Open Patent Specification No. 88132/1985 shows an apparatus which has been proposed to satisfy such desire. It includes a fiber bundle twisting device which comprises an air jet nozzle and a belt type twisting device. The belt type twisting device comprises two endless belts which are caused to travel in a mutually crossing fashion to nip therebetween a bundle of fibers leaving the nozzle. This twisting device does not employ any compressed air, but twists the fiber bundle nipped between the belts. Therefore, it has a high twisting efficiency. The component of the force used for moving the belts provides a force for moving the fiber bundle forward and the device can, therefore, prevent any breakage of yarn resulting from an increased tension. These and many other advantages have been found to enable a higher speed of spinning than the conventional air spinning machine can achieve.

The belt type twisting device as hereinabove described is, however, not free from drawbacks. If the position at which the fiber bundle is nipped between the belts varies, there occurs a variation in the degree in which the fiber bundle is twisted. This variation results in the production of uneven or broken yarn. This problem can be overcome to some extent if the air jet nozzle is located close to the intersection of the belts. The structural limitations of the nozzle and the twisting device, however, make it difficult to locate the nozzle sufficiently close to the intersection of the belts to solve the problem completely. The provision of a fiber bundle guide ring between the air jet nozzle and the belt type twisting device contributes to reducing the problem greatly. However, it brings about another problem. It is difficult to pass the fiber bundle through the guide ring.

OBJECT AND SUMMARY OF THE INVENTION

It is an object of the present invention to provide an apparatus for manufacturing a spun yarn including an air jet nozzle and a belt type twisting device, wherein a variation in the degree in which the fiber bundle is nipped in the twisting device is decreased.

According to this invention, there is provided a spinning apparatus comprising an air jet nozzle and a belt type twisting device, the nozzle having a fiber bundle outlet facing the twisting device, and characterized by including a fiber bundle guide having a rear end located close to the intersection of the two belts defining the twisting device. The guide is preferably in the form of a cylinder or spindle.

A shielding device which is disposed between the fiber bundle guide and the twisting device may be provided to restrict the flow of a stream of air from the nozzle to the twisting device.

Furthermore, a device for drawing a yarn leaving the twisting device may be provided on an opposite side of the twisting device from the air jet nozzle.

A fiber bundle leaving the air jet nozzle is carried on a stream of air jetted by the nozzle, is caused to pass through the guide and reaches the intersection of the belts. As the rear end of the guide is located close to the intersection of the belts, it restricts the position of the fiber bundle at the intersection of the belts and prevents any variation thereof.

DETAILED DESCRIPTION OF PREFERRED EMBODIMENTS

Figure 1:
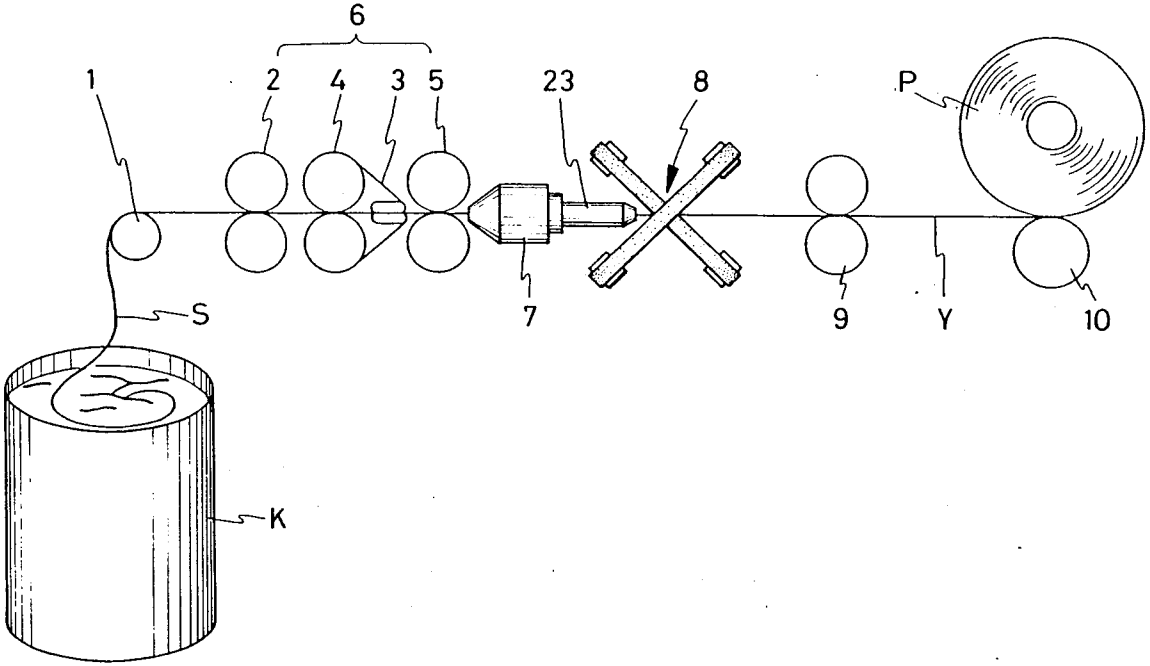
FIG. 1 is a diagrammatic view showing an apparatus embodying this invention.

Referring to FIG. 1, a can K holds the sliver or fiber bundle which has been supplied from a drawing frame. The sliver S is drawn out of the can and is caused to travel past a guide roller 1 and a draft device 6 which comprises back rollers 2, middle rollers 4 having an apron 3 and front rollers 5. It is, then, caused to pass through an air jet nozzle 7 and a belt type twisting device 8. It is pulled through delivery rollers 9 and wound on a package P which is rotated by a friction roller 10.

Figure 2:
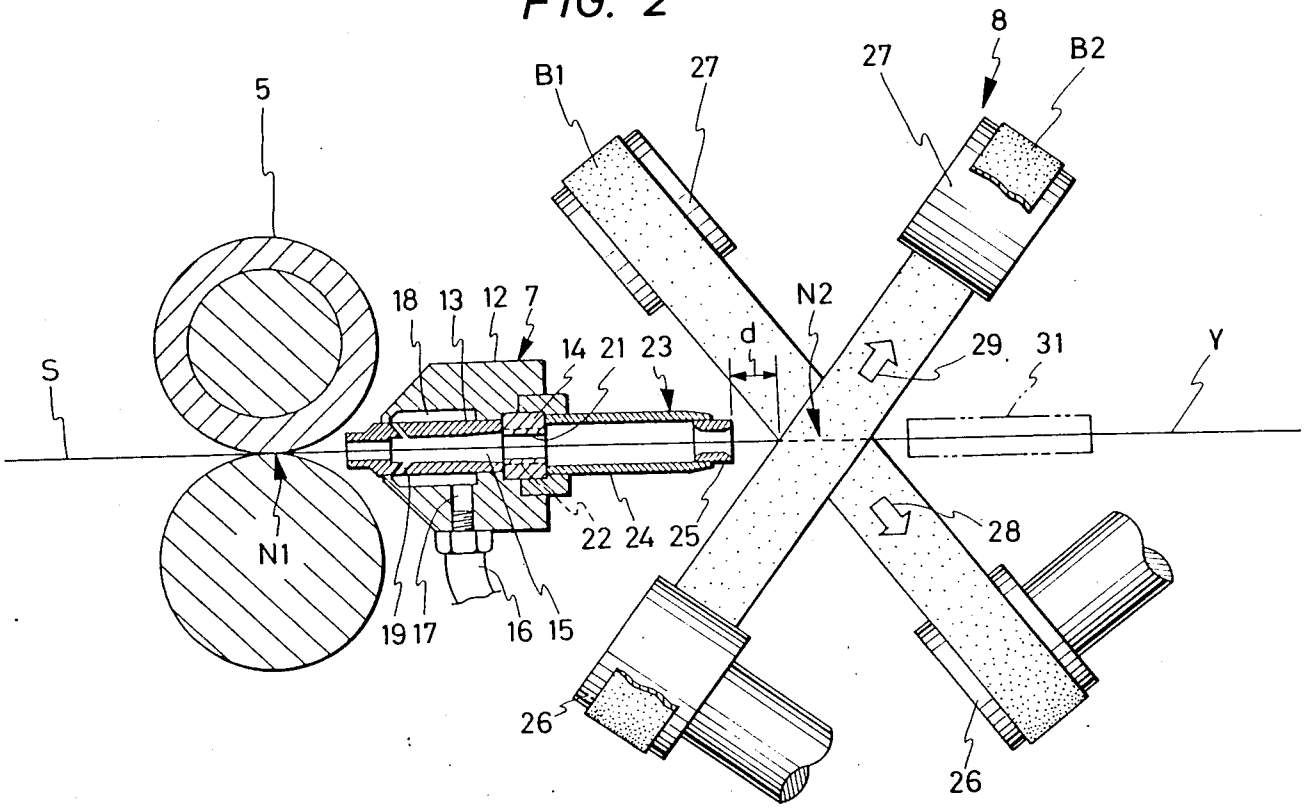
FIG. 2 is a view showing the details of the air jet nozzle and the belt type twisting device.

A first embodiment of this invention is shown in FIG. 2. A jet pipe 13 and an untwisting pipe 14 are fixed in a nozzle body 12 along the longitudinal axis thereof. The pipes 13 and 14 define therethrough an axial fiber bundle passage 15 through which the fiber bundle S leaving the front rollers 5 is passed. The nozzle body 12 has an air port 17 to which an air hose 16 leading to a source of compressed air not shown is connected, and an air chamber 18 surrounding the jet pipe 13 and connected with the air port 17. The jet pipe 13 has a plurality of jet holes 19 which connect the air chamber 18 with the fiber bundle passage 15. The jet holes 19 extend tangentially and at an angle to the fiber bundle passage 15 so that a stream of air which has been jetted into the passage 15 may flow to the right as viewed in FIG. 2, while swirling. The untwisting pipe 14 has a cylindrical axial bore 21 around which a plurality of grooves 22 are formed in parallel to the direction of travel of the fiber bundle S, so that the swirling stream of air reaching from the jet pipe 13 may be caused to flow in parallel to the grooves 22. A fiber bundle guide 23 is secured to the rear end of the untwisting pipe 14. The guide 23 comprises a hollow cylindrical guide pipe 24 and a guide ring 25 secured to the rear end of the guide pipe 24 and formed from a ceramic or other wear-resistant material. The guide ring 25 has a rear end located sufficiently close to the intersection of the belts defining the belt type twisting device 8.

The belt type twisting device 8 comprises two endless rubber belts B1 and B2 each extending about a driving pulley 26 and a driven pulley 27. The belts B1 and B2 cross each other in a way defining the shape of the letter X so that the fiber bundle S may be nipped therebetween. If the driving pulleys 26 are rotated, the belts B1 and B2 are caused to move in the directions of arrows 28 and 29, respectively. The components of the forces applied to move the belts cause the fiber bundle S to be twisted and move to the right as viewed in FIG. 2. The belts B1 and B2 are so positioned that the fiber bundle S may be twisted by the twisting device 8 in the direction which is opposite to the swirling direction of the air stream created by the air jet nozzle 7.

The operation of the spinning apparatus as hereinabove described will now be described. The twist formed on the fiber bundle S by the belt type twisting device 8 reaches the nip point $N_1$ of the front rollers 5. This twist catches the fibers in the center of the untwisted fiber bundle S leaving the nip point $N_1$, but the fibers in the outer periphery of the bundle project in a fluffy pattern. The fiber bundle S entering the jet pipe 13 is formed into a balloon by the swirling stream of air coming through the jet holes 19. This ballooning causes the fluffy fibers to be wound about the twisted fibers in the direction of the balloon, or in the direction opposite the direction in which the central fibers are twisted. The fiber bundle S leaving the twisting device 8 is subjected to a strong untwisting action. The fibers in the central portion of the bundle restore their untwisted or loosely twisted form, while the outer fibers are more strongly wound, whereby a bound spun yarn Y is produced.

As the fiber bundle S is ballooned by the air jet nozzle 7, and as it has some unevenness in fiber thickness unlike a bundle of filaments, it is likely to vary in position at the nip point or belt intersection $N_2$ of the belt type twisting device 8. The variation in position of the fiber bundle S at the intersection $N_2$ causes a change in length of the fiber bundle portion nipped by the belts B1 and B2 and thereby a variation in the degree of twisting by the twisting device 8, resulting in the production of spun yarn Y lacking uniformity.

The fiber bundle guide 23 prevents any such variation in position of the fiber bundle. The guide ring 25 located close to the belt intersection $N_2$ restricts the position of the fiber bundle S and guides it to the center of the intersection $N_2$. While the distance d between the guide ring 25 and the intersection $N_2$ had better be shortened as far as possible, it is at least preferable that it is smaller than the length of the short fibers forming the fiber bundle S. The guide pipe 24 supports the guide ring 25 and guides the fiber bundle S from the untwisting pipe 14 to the guide ring 25 on the stream of air. If the guide pipe 24 were not provided, the fiber bundle S leaving the untwisting pipe 14 would be caused to flow transversely by the diffusion of the air and would, therefore, be difficult to pass into the guide ring 25 when it must be passed from the air jet nozzle 7 to the twisting device 8 to start the spinning operation. The manual insertion of the fiber bundle S into the guide ring 25 is a very difficult job, the fiber bundle which has not yet been twisted by the twisting device 8 is easily broken. The guide pipe 24 has an inside diameter which can maintain the necessary speed for carrying the fiber bundle S to the guide ring 25 and the belt intersection $N_2$. The guide ring 25 has an inside diameter which enables the effective removal of air from the guide pipe and also the control of the fiber bundle S against any variation in position. In order to further ensure the prevention of the fiber bundle S from any positional variation, it is effective to provide an appropriate guide member 31 on the opposite side of the intersection $N_2$ from the guide ring 25, too.

Figure 3:
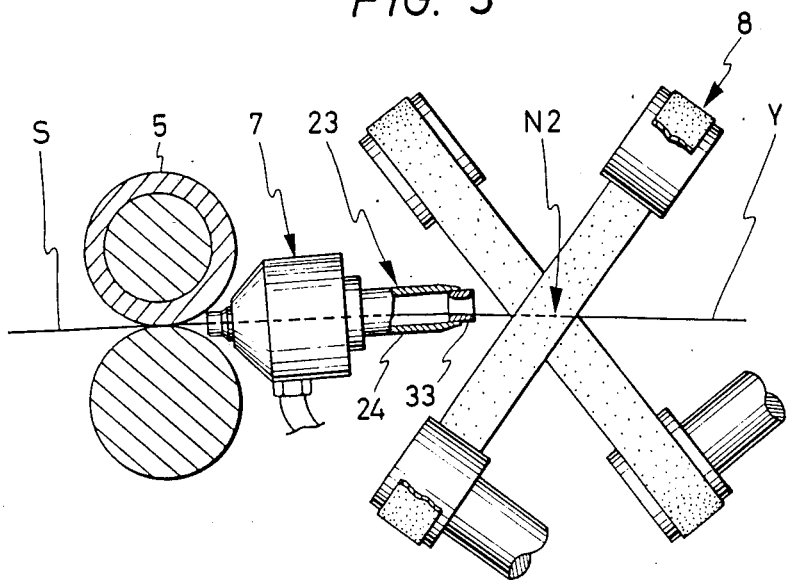
FIG. 3 is a view showing another embodiment of this invention.
Figure 4A:
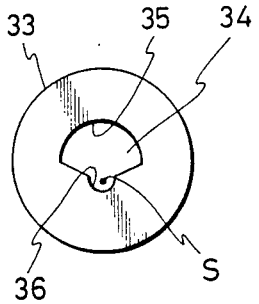
FIGS. 4*a* and 4*b* are a front elevational view and a longitudinal sectional view, respectively, of the guide ring in the apparatus of FIG. 3.
Figure 4B:
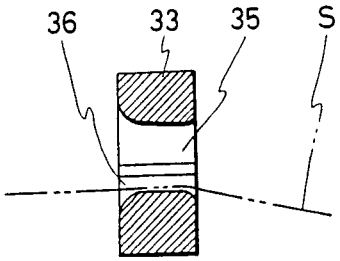

A second embodiment of this invention is shown in FIG. 3. The air jet nozzle 7 and the fiber bundle guide 23 are slightly inclined with respect to the path along which the fiber bundle S travels. The fiber bundle S slightly contacts the peripheral wall of the bore of a guide ring 33 at the bottom thereof, so that the fiber bundle leaving the guide ring may be slightly downwardly bent to travel through the center of the belt intersection of the belt type twisting device 8. The guide ring 33 is shown in further detail in FIGS. 4*a* and 4*b*. The axial bore 34 of the guide ring 33 through which the fiber bundle S is passed has a substantially sectoral shape defined by an upper bore portion 35 having a large diameter and a lower bore portion 36 having a small diameter. The tension of the fiber bundle S positions it in the lower bore portion 36. The lower bore portion 36 has so small a diameter that the fiber bundle S contacts the peripheral wall thereof, so that it may be reliably directed to the center of the belt intersection $N_2$. The upper bore portion 35 is a passage for a stream of air created by the air jet nozzle 7 and does not directly contribute to guiding the fiber bundle S. The upper bore portion 35 has a sufficiently large diameter to enable the air stream to flow therethrough effectively.

This invention is not limited to the two embodiments which have been described, but various modifications may be possible. For example, the guide pipe 23 can be provided with small air vents through its wall. The guide pipe 24 or the guide ring 25 or 33 may be of the conical construction or of the channel-shaped construction having a U-shaped cross section. The guide pipe 24 does not necessarily need to be connected to the air jet nozzle 7, but can be spaced apart therefrom to some extent if it can guide the fiber bundle S into the guide ring 25 or directly to the belt intersection $N_2$ on the stream of air created by the nozzle 7. The draft device 6 can, for example, comprise four kinds of rollers instead of the three kinds of rollers as hereinabove described.

Figure 5:
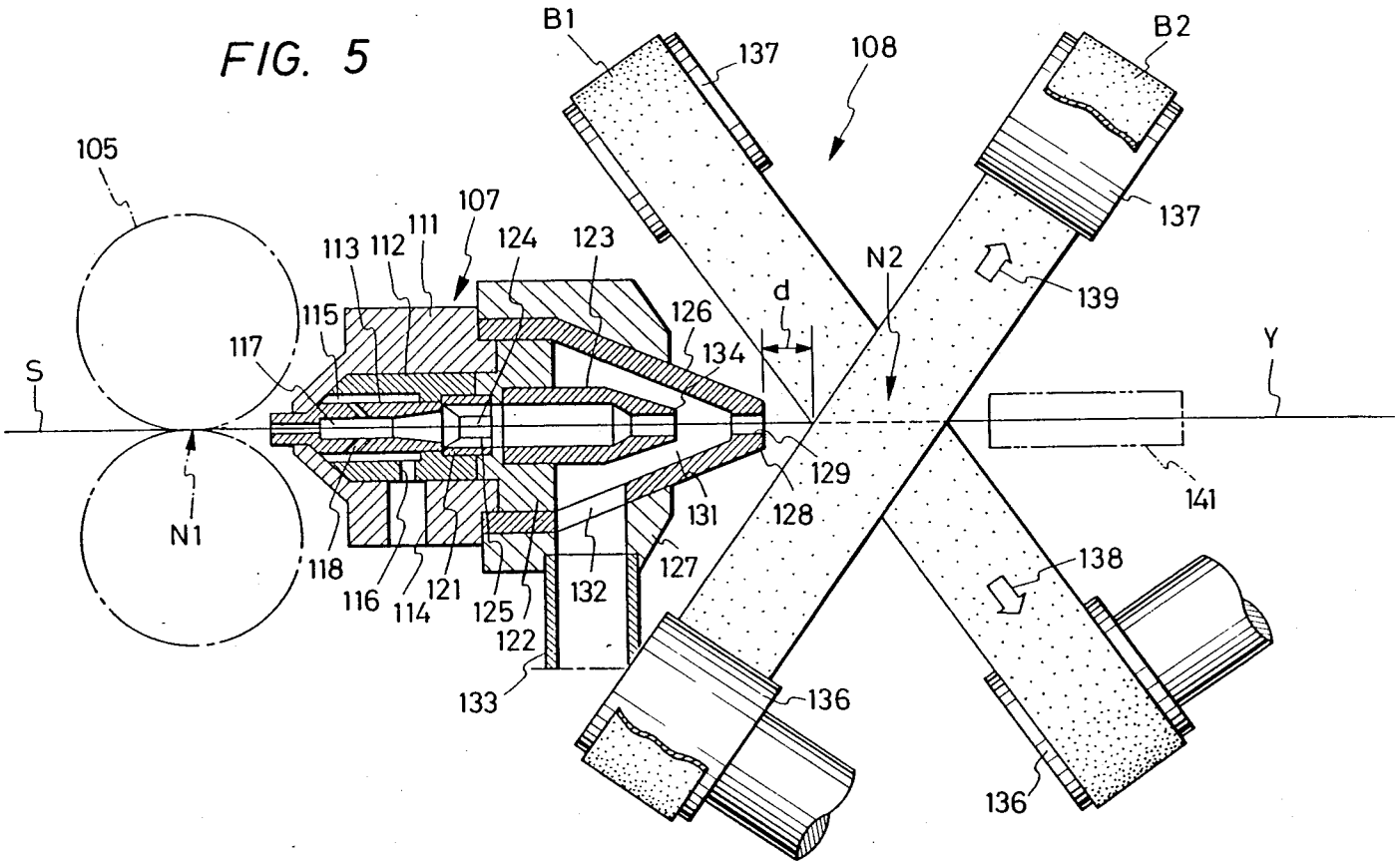
FIG. 5 is a view showing still another embodiment of this invention.

Reference is now made to FIG. 5 showing a third embodiment of this invention. This apparatus is characterized by including between an air jet nozzle and a twisting device a fiber bundle guide and a shielding device provided between the fiber bundle guide and the twisting device for restricting the flow of a stream of air from the nozzle to the twisting device.

A nozzle body 111 has an axial bore in which a cylindrical member 112 is tightly fitted. A jet pipe 113 is secured in the cylindrical member 112. The nozzle body 111 has an air port 114 which can be connected to a source of compressed air not shown. The cylindrical member 112 and the jet pipe 113 define an annular air chamber 115 therebetween. The cylindrical member 112 has a port 116 which connects the air chamber 115 with the air port 114. The jet pipe 113 has an axial fiber bundle passage 117 and a plurality of jet holes 118 which connect the passage 117 with the air chamber 115, so that the compressed air which has been introduced through the air port 114 may be blown into the fiber bundle passage 117 through the port 116, the air chamber 115 and the jet holes 118 to act on the fiber bundle S traveling through the passage 117. The jet holes 118 extend tangentially and at an angle to the fiber bundle passage 117 so that the compressed air entering the passage 117 may flow to the right as viewed in FIG. 5, while swirling. An untwisting pipe 121 is connected to the rear end of the jet pipe 113. A guide pipe 123 is connected to the nozzle body 111 by an annular member 122. The untwisting pipe 121 has a cylindrical axial bore 124 about which a plurality of grooves 125 are provided in parallel to the direction of travel of the fiber bundle S, so that a part of the swirling stream of air created by the jet pipe 113 may flow along the grooves 125 and thereby cease to swirl. A conical shielding member 126 is secured to the outer periphery of the annular member 122 and surrounds the guide pipe 123. A cylindrical block 127 is secured to the outer periphery of the shielding member 126. The shielding member 126 has an end 128 facing a twisting device 108 and located close to its belt intersection. The end 128 has a guide hole 129 through which the fiber bundle S is passed. The jet pipe 113, the untwisting pipe 121, the guide pipe 123 and the shielding member 126 define a longitudinally aligned fiber bundle passage having an axis lying on a straight line passing through the nip point $N_1$ of the front rollers 105 and the center of the belt intersection $N_2$. The shielding member 126 has an air diffusion chamber 131 defined by the annular member 122, the guide pipe 123 and the member 126. Adjacent to the annular member 122, the shielding member 126 has an air outlet 132 which is connected to an air collecting device not shown through a port in the block 127 and an air hose 133. The guide pipe 123 has an end projecting into the diffusion chamber 131 and defining a fiber bundle outlet 134 which is spaced apart from the guide hole 129, but is sufficiently close thereto. While a part of the air flowing out of the guide pipe 123 flows through the guide hole 129 with the fiber bundle S, the majority thereof stays in the shielding member 126 by decreasing its flowing speed upon entering the diffusion chamber 131 or by impinging upon the inner wall surface of the shielding member 126 and is exhausted through the air outlet 132.

The belt type twisting device 108 comprises two endless rubber ebelts B1 and B2 each extending about a driving pulley 136 and a driven pulley 137. The belts B1 and B2 cross each other in a way forming the shape of the letter X and can nip the fiber bundle S therebetween. The belts B1 and B2 are movable in the directions of arrows 138 and 139, respectively. The components of the force applied to move the belts cause the fiber bundle S to be twisted, while traveling to the right. The fiber bundle S is twisted in the direction opposite the direction in which the stream of air leaving the jet holes 118 swirls.

In operation, the sliver S leaving the draft device is twisted by the belt type twisting device 108 and the twist formed on the fiber bundle S reaches the nip point $N_1$ of the front rollers 105. While this twist catches the fibers in the inner portion of the fiber bundle S leaving the front rollers 105, the fibers in the outer portion thereof are not caught, but project in a fluffy pattern. The fiber bundle S is, then, rotated or ballooned by the sirling stream of air in the jet pipe 113 in the direction opposite the direction in which it has been twisted. The fluffy fibers in the outer portion of the fiber bundle are wound in the same direction with the swirling stream of air, or in the direction opposite the direction in which the inner fibers have been twisted. When passing through the belt intersection $N_2$ of the twisting device 108, the fiber bundle S receives a strong untwisting action and the fibers in the inner portion of the fiber bundle restore their untwisted or loosely twisted form, while the fibers in the outer portion thereof are firmly wound about the inner fibers, whereby the fiber bundle S forms a bound spun yarn Y.

The fiber bundle S produces flying waste under the drafting action of the draft device or under the action of the swirling stream of air in the jet pipe 113. The flying waste is carried with the fiber bundle S on the air stream to the right as viewed in FIG. 5. The flying waste reaching the twisting device 108 is scattered by the stream of air which is created along the belts B1 and B2 when they are driven. The majority of the flying waste adhering to the opposite sides of the belts and the pulleys 136 and 137 is scattered away by the belts B1 and B2 contacting each other, while a part thereof adheres to the surface of the fiber bundle S or the yarn Y or is sometimes twisted thereinto to form a slab or thick yarn portion. The flying waste adhering to the outer peripheries of the pulleys 136 and 137 and the back sides of the belts is likely to cause the belts to slip on the pulleys and thereby vibrate, resulting in the production of yarn Y lacking twisting uniformity or the removal of the belts from the pulleys. The flying waste scattering around the twisting device is likely to adhere to the adjoining devices and cause their failure, as well as the worsening of the working environment. According to the apparatus of this invention, the majority of the flying waste leaving the guide pipe 123 is prevented from flowing to the right by the reduction in the flowing speed of the air stream in the diffusion chamber 131, or by impingement upon the inner wall surface of the shielding member 126, or by the stream of air drawn out through the air outlet 132 and is discharged from the diffusion chamber 131 through the air outlet 132, while only a small part thereof flows out through the guide hole 129 with the fiber bundle S and reaches the twisting device 108. The amount of the flying waste reaching the twisting device 108 is so small that it does not present any of the problems as hereinabove pointed out.

It is preferable for the guide hole 129 of the shielding member 126 to be located as close to the belt intersection $N_2$ as possible. The guide hole 129 is provided for controlling the position of the fiber bundle S so that it may stably travel through the center of the belt intersection $N_2$. The closer the guide hole 129 is to the intersection $N_2$, the more reliably it can attain its object. If the path along which the fiber bundle S travels varies in the belt intersection $N_2$, there occurs a change in the length of that portion of the fiber bundle S which is nipped by the belts B1 and B2 and the number of twist is, therefore, very likely to become uneven. If the distance d between the guide hole 129 and the belt intersection $N_2$ is larger, the flying waste staying on that portion of the fiber bundle S leaving the guide hole 129 which is exposed between the guide hole 129 and the belt intersection $N_2$ is very likely to be scattered by the stream of air created by the moving belts B1 and B2 and thereby give rise to the problems which have been pointed out.

When the spinning operation is started, the fiber bundle S is introduced into the jet pipe 113 through the draft device, carried forward into the guide pipe 123 by the stream of air from the jet holes 118, and brought to the belt intersection $N_2$ of the twisting device 108 through the guide hole 129. Therefore, it is preferable for the air stream leaving the guide pipe 123 to maintain at least a flowing speed which enables the fiber bundle S to pass through the guide hole 129. Therefore, the air outlet 132 is preferably remote from the area between the end 134 of the guide pipe and the guide hole 129. Alternatively, it is effective to increase the flow rate of air through the jet holes 118 when passing the fiber bundle S from the air jet nozzle 107 to the twisting device 108. It is also effective to interrupt the drawing of air through the air outlet 132 when passing the fiber bundle S through the guide hole 129.

The shielding member 126 is not limited to the construction shown in FIG. 5, but various modifications are possible. For example, it is possible to allow flying waste to drop by gravity to remove it from the diffusion chamber 131, instead of drawing air through the air outlet 132. The shielding member 126 may comprise a simple plate disposed between the air jet nozzle 107 and the twisting device 108. In order to ensure the guiding of the fiber bundle S through the guide hole 129, it is effective to provide another guide member 141 on the opposite side of the twisting device 108 from the air jet nozzle 107 as shown by broken lines in FIG. 5.

Figure 6:
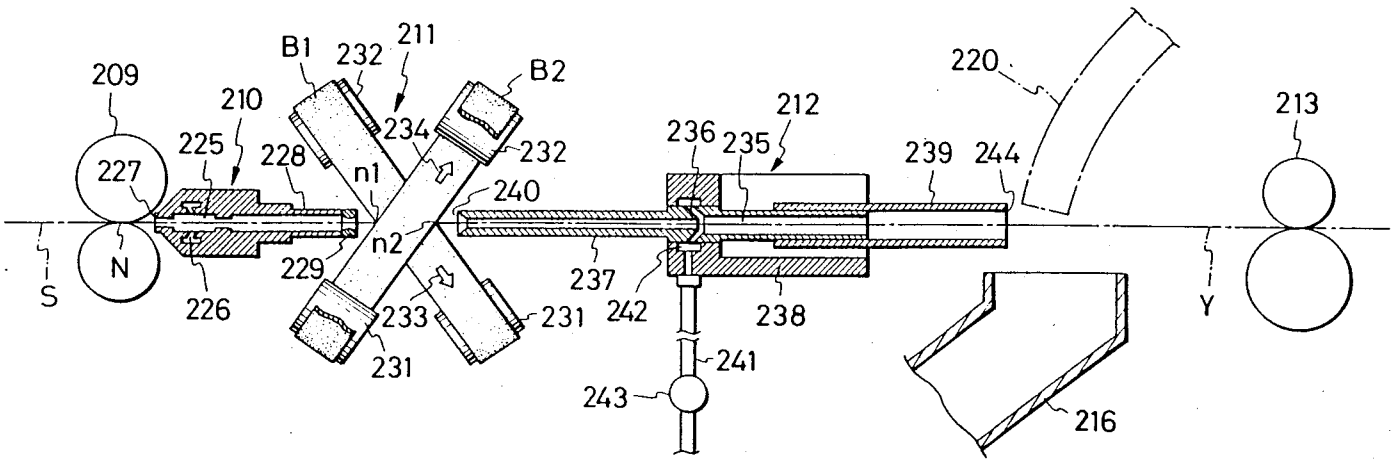
FIG. 6 is a view showing a further embodiment of this invention.

Attention is now directed to FIG. 6 showing a fourth embodiment of this invention. This apparatus is characterized by including an air jet nozzle provided between a draft device and a twisting device and a device provided on the opposite side of the twisting device from the nozzle for drawing the yarn leaving the twisting device.

The air jet nozzle 210 has an axial passage 225 for the fiber bundle S and a plurality of air jet holes 226 formed in the peripheral wall surface surrounding the fiber bundle passage 225. The jet holes 226 are tangential to the cylindrical periphery of the passage 225 and the inclined toward the twisting device 211. Compressed air is constantly supplied from a source of compressed air not shown to the jet holes 226. The compressed air is blown into the fiber bundle passage 225 through the jet holes 226 to form a swirling stream of air flowing toward the twisting device 211. This air stream acts on the fiber bundle S in the passage 225 to form a balloon thereon. The air jet nozzle 210 has a fiber bundle inlet 227 located close to the nip point N of the front rollers 209 in the draft device. The nozzle 210 has a fiber bundle outlet provided with a guide pipe 228 located close to the nip starting point n1 of the twisting device 211. The guide pipe 228 has an end provided with a fiber bundle guide ring 229 which ensures the correct positioning of the fiber bundle S at the nip starting point n1.

The belt type twisting device 211 comprises two endless belts B1 and B2 each extending about a driving pulley 231 and a driven pulley 232. The belts B1 and B2 cross each other in a way defining the shape of the letter X and nip the fiber bundle S therebetween. The belts B1 and B2 are constantly movable in the directions of arrows 233 and 234. The components of the force applied for moving the belts cause the fiber bundle S to be twisted, while moving it toward the drawing device 212. The fiber bundle is twisted in the direction opposite the direction in which the air stream leaving the jet holes 226 of the nozzle 210 swirls.

The fiber bundle S leaving the draft device is twisted by the belt type twisting device 211. The twist on the fiber bundle S reaches the nip point N of the front rollers 209. While this twist catches the fibers in the inner portion of the fiber bundle S leaving the front rollers 209, the fibers in the outer portion thereof are not caught, but project in a fluffy pattern. The fiber bundle S is, then, subjected to the action of the swirling stream of air in the air jet nozzle 210 and is thereby ballooned in the direction opposite the direction in which it has been twisted. The fluffy fibers on the outer portion of the fiber bundle are wound in the same direction with the swirling stream of air, or in the direction opposite the direction in which the inner fibers have been twisted. The fiber bundle S leaving the nip ending point n2 of the twisting device 211 receives a strong untwisting action and the fibers in the inner portion of the fiber bundle restore their untwisted or loosely twisted form, while the outer fibers are strongly wound about the inner fibers, whereby the fiber bundle S forms a bound spun yarn Y.

The drawing device 212 comprises a guide pipe 237 having an axial passage 235 for the yarn Y and a plurality of air jet holes 236 opening to the yarn passage 235. The pipe 237 is supported by a block 238 and a connecting pipe 239 is connected to the guide pipe 237. The yarn passage 235 has a smaller diameter between the twisting device 211 and the inner ends of the jet holes 236 than between the inner ends of the jet holes 236 and delivery rollers 213. The jet holes 236 are inclined toward the delivery rollers 213 and the inner ends thereof are open to the enlarged diameter portion of the yarn passage. That end 240 of the guide pipe 237 which defines the end of the reduced diameter portion of the yarn passage remote from the jet holes is located close to the nip ending point n2 of the twisting device 211. The block 238 defines therein an annular air chamber 242 which connects the air jet holes 236 with a pipe 241 extending from a source of compressed air not shown. An electromagnetic valve 243 is provided in the pipe 241. If the valve 243 is opened, compressed air is supplied into the yarn passage 235 through the pipe 241, the air chamber 242 and the jet holes 236 to create therein a stream of air flowing from the twisting device 211 to the delivery rollers 213. The valve 243 opens upon the engagement of a clutch on the back rollers (as shown at 2 in FIG. 1) when a joining truck not shown has stopped for joining yarn ends. The air stream creates at the end 240 of the guide pipe a sucking force which drawn the yarn Y leaving the twisting device 211 toward the delivery rollers 213. The valve 243 is closed by a timer not shown to discontinue the supply of air. The connecting pipe 239 is threadedly fitted about the guide pipe 237 and is axially movable so that its free end 244 may be positioned in the vicinity of the open end of a duct 216.

When the valve 243 has been opened as hereinabove described, the fiber bundle S leaving the draft device is introduced into the air jet nozzle 210, carried by the swirling stream of air in the nozzle 210 to the twisting device 211 and nipped between the belts B1 and B2. The fiber bundle S is moved forward by the action of the moving belts B1 and B2 and the sucking action of the drawing device 212. The yarn is drawn through the yarn passage 235 into the duct 216. Then, the valve 243 is closed and a suction pipe 220 is swung to its position shown by broken lines in FIG. 6 to draw out the yarn Y from the duct 216 and carry it to the knotter not shown for joining purposes. Although the belts B1 and B2 of the twisting device 211 can be separated from each other when the fiber bundle is fed therebetween, it is entirely possible to pass it therebetween even if they may remain in contact with each other as when they are used for the twisting operation. In order to ensure the accurate insertion of the fiber bundle through the twisting device, it is preferable to locate the ends 229 and 240 of the air jet nozzle 210 and the drawing device 212, respectively, as close to the nip points n1 and n2, respectively, of the belts as possible. The location of the ends 229 and 240 close to the nip points n1 and n2 also ensures the maintenance of the fiber bundle S in the center of the belt intersection throughout the twisting operation and thereby prevents any displacement of the path along which the fiber bundle travels, thereby enabling the production of yarn Y of high quality which is substantially free from any twisting unevenness. Although the electromagnetic valve 243 may be of the type which is normally open, it is undesirable from the standpoint of energy saving. If dusty cotton, etc. gather in the yarn passage 235 of the drawing device 212, the valve 243 can be opened at appropriate intervals of time to introduce a stream of air to clean the passage 235. The air jet holes 236 can be disposed tangentially to the yarn passage as the jet holes of the air jet nozzle 210 are, so that the air stream in the yarn passage may swirl in the same direction as the air stream in the nozzle 210 or in the opposite direction.

According to this invention, the fiber bundle guide provided between the air jet nozzle and the belt type twisting device prevents any positional variation of the fiber bundle at the intersection of the belts and thereby enables the production of good spun yarn which is uniformly twisted. The guide is located between the fiber bundle outlet of the air jet nozzle and the intersection of the belts and thereby facilitates the feeding of the fiber bundle from the nozzle to the twisting device when the spinning operation is started.

What is claimed is:

1. An apparatus for manufacturing spun yarn comprising a draft device composed of back, middle and front rollers, an air jet nozzle for supplying a swirling air stream to a fiber bundle, a belt type twisting device including two mutually crossing belt adapted for movement in different directions, said draft device, said nozzle and said twisting device being located one after another along a path along which said fiber bundle is adapted to travel, said nozzle having an outlet for said fiber bundle, and a fiber bundle guide provided at said outlet and having a rear end adjacent to the intersection of said belts so that said rear end of the fiber bundle guide ensures to position the fiber bundle at the intersection of said belts.

2. An apparatus as claimed in claim 1, wherein said fiber bundle guide has a guide ring at the rear end thereof and the distance between the guide ring and the intersection is smaller than the length of the short fibers forming the fiber bundle.

3. An apparatus as claimed in claim 1, wherein another guide member is provided on the opposite side of the intersection from the fiber bundle guide along the fiber bundle travelling path.

4. An apparatus as claimed in claim 1, wherein a center line of said nozzle and said fiber bundle guide is slightly inclined with respect to the path along which the fiber bundle is adapted to travel so that the fiber bundle contacts the peripheral wall of the bore of the guide ring at the bottom thereof.

5. An apparatus as claimed in claim 4, wherein a section of the bore of said guide ring has a substantially sectoral shape defined by an upper bore portion having a large diameter and a lower bore portion having a smaller diameter so that the fiber bundle positions at the lower portion having a smaller diameter on travelling thereof.

6. An apparatus as claimed in claim 1, wherein a shielding device for restricting the flow of a stream of air from the nozzle to the twisting device is further included between the fiber bundle guide and the belt type twisting device.

7. An apparatus as claimed in claim 6, wherein said shielding device is formed substantially in a conical shape which surrounds the fiber bundle guide and has an end facing the twisting device and located close to the belt intersection of the twisting device, and a guide hole is provided at the end of the shielding device to pass the fiber bundle therethrough.

8. An apparatus as claimed in claim 7, wherein said shielding device supports the fiber bundle guide within the conical shape thereof by means of an annular member and an air diffusion chamber which is defined by the outer peripheral surface of the fiber bundle guide and the inner peripheral surface of the shielding device includes an air outlet through which the air flowing out of the fiber bundle guide is exhausted.

9. An apparatus as claimed in claim 8, wherein said air outlet is communicated with an air suction source and the exhausted air into the air diffusion chamber is forcively discharged.

10. An apparatus as claimed in claim 1, wherein a drawing device for drawing a yarn leaving the twisting device is provided on the opposite side of the twisting device from the fiber bundle guide along the path which the fiber bundle is adapted to travel.

11. An apparatus as claimed in claim 10, wherein said drawing device comprises a guide pipe having an axial passage for the yarn and a plurality of second jet holes opening to the yarn passage, a block supporting the guide pipe and a connecting pipe connected to the guide pipe.

12. An apparatus as claimed in claim 11, wherein said second jet holes are inclined to be opened toward the yarn leaving end, the yarn passage has a smaller diameter between an inlet end of the guide pipe and the second jet hole while the yarn passage has enlarged diameter between the second air jet hole and an outlet end of the guide pipe, and the end of the guide pipe which defines the end of the reduced diameter portion of the yarn passage is located close to the intersection of the belts.

* * * * *